US010446128B2

(12) United States Patent
Parker

(10) Patent No.: US 10,446,128 B2
(45) Date of Patent: Oct. 15, 2019

(54) INTERVAL-BASED MUSICAL INSTRUMENT

(71) Applicant: Matthew David Parker, Groton, CT (US)

(72) Inventor: Matthew David Parker, Groton, CT (US)

( * ) Notice: Subject to any disclaimer, the term of this patent is extended or adjusted under 35 U.S.C. 154(b) by 0 days.

(21) Appl. No.: 15/150,427

(22) Filed: May 9, 2016

(65) Prior Publication Data

US 2017/0323624 A1 Nov. 9, 2017

(51) Int. Cl.

| | |
|---|---|
| ***G10H 1/34*** | (2006.01) |
| ***G10H 1/14*** | (2006.01) |
| ***G10H 1/00*** | (2006.01) |
| ***G10H 1/46*** | (2006.01) |
| ***G10H 1/055*** | (2006.01) |

(52) U.S. Cl.

CPC ..... *G10H 1/14* (2013.01); *G10H 1/0066* (2013.01); *G10H 1/0555* (2013.01); *G10H 1/0558* (2013.01); *G10H 1/342* (2013.01); *G10H 1/46* (2013.01); *G10H 2210/195* (2013.01); *G10H 2220/155* (2013.01); *G10H 2220/161* (2013.01); *G10H 2220/191* (2013.01); *G10H 2220/315* (2013.01); *G10H 2230/075* (2013.01); *G10H 2230/155* (2013.01); *G10H 2230/211* (2013.01); *G10H 2230/245* (2013.01)

(58) Field of Classification Search

USPC ..... 84/615

See application file for complete search history.

(56) References Cited

U.S. PATENT DOCUMENTS

| | | | | |
|---|---|---|---|---|
| 4,499,808 | A * | 2/1985 | Aoki | G10H 1/38 84/649 |
| 5,440,071 | A * | 8/1995 | Johnson | G10H 1/34 84/637 |
| 5,565,641 | A * | 10/1996 | Gruenbaum | G10H 1/0066 84/451 |
| 5,777,250 | A * | 7/1998 | Aoyama | G10H 1/383 84/604 |
| 5,777,251 | A * | 7/1998 | Hotta | G10H 1/0008 84/609 |
| 5,824,927 | A * | 10/1998 | Tonon | G10B 1/08 84/375 |
| 7,812,242 | B2 * | 10/2010 | Yamabata | G10H 1/053 84/629 |
| 8,802,958 | B2 * | 8/2014 | Henriques | G10H 3/14 84/723 |
| 8,827,806 | B2 | 9/2014 | McCauley et al. | |

OTHER PUBLICATIONS

Lages et al, "Interval Player: Designing a virtual musical instrument using in-air gestures", 2015 IEEE Symposium on 3D User Interfaces (3DUI), Mar. 2015, 203-204, IEEE.

* cited by examiner

*Primary Examiner* — Christopher Uhlir
(74) *Attorney, Agent, or Firm* — Juan Quiroz Aguilera

(57) ABSTRACT

Embodiments are directed to a musical instrument having buttons, where the buttons determine the magnitude of the interval by which the melody will jump from the last note played. With a small number of interval buttons and an up/down strum bar, embodiments can play almost any melody and more notes than a piano. One embodiment is directed to an interval-based guitar including fret buttons whose input signals are used to calculate the interval by which to change the pitch of the prior note. Providing input via a strum bar or a sensor, a new note is generated by adding or subtracting the interval to/from the prior note to generate a new note.

17 Claims, 26 Drawing Sheets

INTERVAL-BASED MUSICAL INSTRUMENT

CROSS-REFERENCES TO RELATED APPLICATIONS

Not applicable.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

Musical instruments that play different pitches have some way for the musician to specify which pitch to play. Manipulating an instrument in a certain way will produce a particular pitch. For example, pressing A on the piano will produce a pitch at about 440 Hz, pressing the first fret on the E string of a standard guitar will produce a pitch corresponding to F, etc. Other instruments separate what determines the pitch from what plays the pitch. In wind instruments like flutes or horns, the holes are blocked with the fingers or buttons to indicate pitch, but a note is played only when wind is blown into the mouthpiece. With stringed instruments like guitars or violins, a string is pressed at a certain spot on the neck to indicate the pitch, and the pitch is turned into sound by plucking, striking, or scraping the string at a different location. Sometimes, such as with flutes and trumpets, the pitch can also be made to jump an octave, or bend a little, by blowing into the mouthpiece differently.

In Western music, there are traditionally 12 notes in an octave. An octave of any note is double or half its frequency. The twelve notes, in equal temperament tuning, are approximately evenly proportioned jumps in frequency. This is commonly referred to as the chromatic Western scale. For example, a full sized piano has 88 keys and can represent seven octaves and four additional notes.

MIDI (Musical Instrument Digital Interface) is a technical standard that describes a protocol, digital interface and connectors, that allows a wide variety of electronic musical instruments, computers, and other related devices to connect and communicate with one another. MIDI carries event messages that specify notation, pitch and velocity, control signals for parameters such as volume, vibrato, audio panning, cues, and clock signals that set and synchronize tempo between multiple devices. These messages are sent via a MIDI cable to other devices where they control sound generation and other features.

In its simplest form, a MIDI instrument sends NOTE_ON and NOTE_OFF events, including a note number that corresponds to notes in the chromatic Western scale. The receiving device, such as a synthesizer, reads the MIDI events and transforms the notes into actual sounds at particular frequencies. Besides NOTE_ON and NOTE_OFF events, MIDI can also send events that dynamically change the volume, bend the pitch, or control various musical effects.

BRIEF DESCRIPTION OF THE INVENTION

Embodiments are directed to a musical instrument having buttons, where the buttons determine the magnitude of the interval by which the new note will jump from the previously played note. With a small number of interval buttons, embodiments can play almost any melody and more notes than a piano. One embodiment is directed to an interval-based guitar having one or more fret buttons on the neck of the guitar and a strum bar on the body of the guitar. When the strum bar is moved down, the interval (based on the pressed fret buttons) is subtracted from the previously played note; when the strum bar is moved up, the interval is added to the previously played note (or vice-versa). A processor within the interval-based guitar receives the state of the fret buttons and the state of the strum bar, and accordingly generates the new note. Embodiments can also include additional sensors to generate MIDI effects for the generated note.

Yet another embodiment is directed to an interval-based instrument consisting of a neck with fret buttons that attaches to a smartphone, tablet, or some other external device. An application running on the external device receives the state information of the fret buttons, allows the user to generate a new note by performing an action (such as strumming), and saves the new note.

DETAILED DESCRIPTION OF THE INVENTION

Figure 1A:
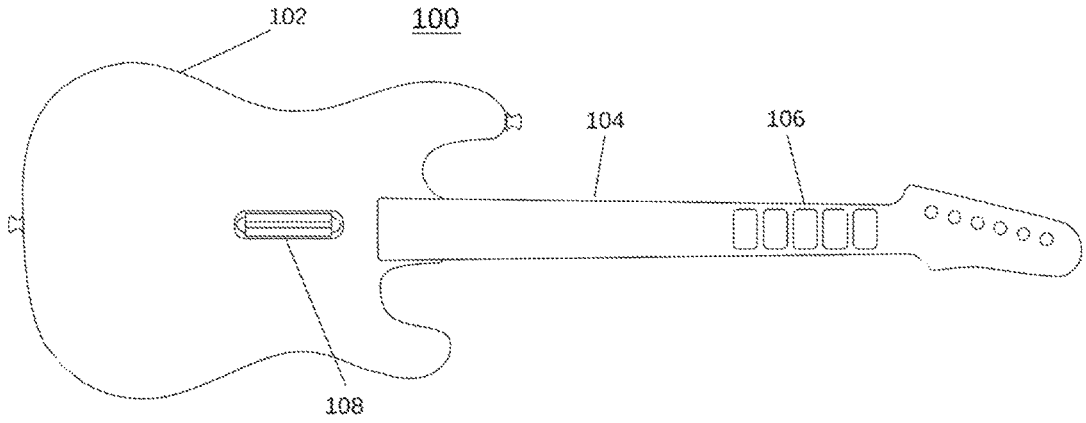
FIG. 1A illustrates a top down view of an embodiment of an interval-based guitar.

An embodiment is directed to an interval-based musical instrument consisting of a guitar-shaped housing, one or more buttons on the neck of the guitar, and a strum-bar in the body of the guitar. Without pressing any buttons, moving the strum bar plays a starting note. The buttons determine the interval distance that the new note will jump from the last note played (also referred to as the "prior note"). When moving the strum bar up, the buttons pressed determine the interval distance to add to the last note played. Moving the strum bar down, with the buttons pressed, determines the interval distance to subtract from the last note played. This results in a new note, which is saved in memory, and used to generate the next note.

The term "fret button" and "interval button" will also be used to refer to the buttons on the neck of the guitar, whose state or input signals determine the interval by which to change the prior note. While fret buttons, or buttons, will be used to describe various embodiments, it is to be understood that other interaction tools and control/input devices can be used without departing from the spirit of embodiments, such as rollers, strings, touchpads, sliders, trackballs, knobs, binary switches, analog sticks, analog control devices, and other sensors.

The fret buttons and the strum bar are connected to a circuit board that generates a MIDI signal. The MIDI signal can then be transmitted to an external device over a cable (USB, MIDI, or some other alternative) or wirelessly (Bluetooth, WiFi, or some other alternative). Instead of generating MIDI signals, embodiments can generate other music protocol signals.

The interval-based instrument can include extra knobs, tilt sensors, accelerometers, gyroscopes, force-sensitivity in the strum bar, and other sensors to control MIDI effects and other functionality of the interval-based instrument. The extra effects of the musical instrument can be configured via buttons, knobs, and other control and input devices on the interval-based instrument. An embodiment can also include a digital display to display configuration options and other status messages. An application on a smartphone or other external device can also provide an interface to configure the various settings of the interval-based instrument.

Embodiments of the interval-based musical instrument are not limited to a guitar-shaped housing. As described further below, the housing of the interval-based musical instrument can be shaped substantially like different types of instruments or it can also be shaped to not look like an ordinary musical instrument (such as the stick and hand controller embodiments). For simplicity and clarity, the guitar-shaped housing and the interval-based guitar will be used to describe embodiments.

Yet another embodiment is directed to an interval-based musical instrument attached to an external device, such as a smartphone or tablet, with the musical instrument consisting only of buttons used to determine the interval distance to add or subtract from the last note played. The strumming can be done via an application on the external device, with the last note played stored on the external device.

FIG. 1A illustrates an embodiment of an interval-based guitar 100. The guitar 100 includes a housing 102 with a neck 104. The neck 104 includes five buttons 106. The housing 102 includes a strum bar 108. Each of the buttons 106 determine the magnitude of the interval by which the melody will jump from the last note played. The initial note played can be any note, such as middle C. The choice of this initial note can be configured by the user. When the strum bar 108 is moved down, the interval by which the melody will jump is subtracted from the previously played note (the prior note). On the other hand, when the strum-bar is moved up, the interval by which the melody will jump is added to the previously played note. Alternatively, the strum bar can also function such that when the strum bar 108 is moved up, the interval by which the melody will jump is subtracted from the previously played note, and when the strum bar is moved down, the interval by which the melody will jump is added to the previously played note to generate the new note.

Figure 1B:
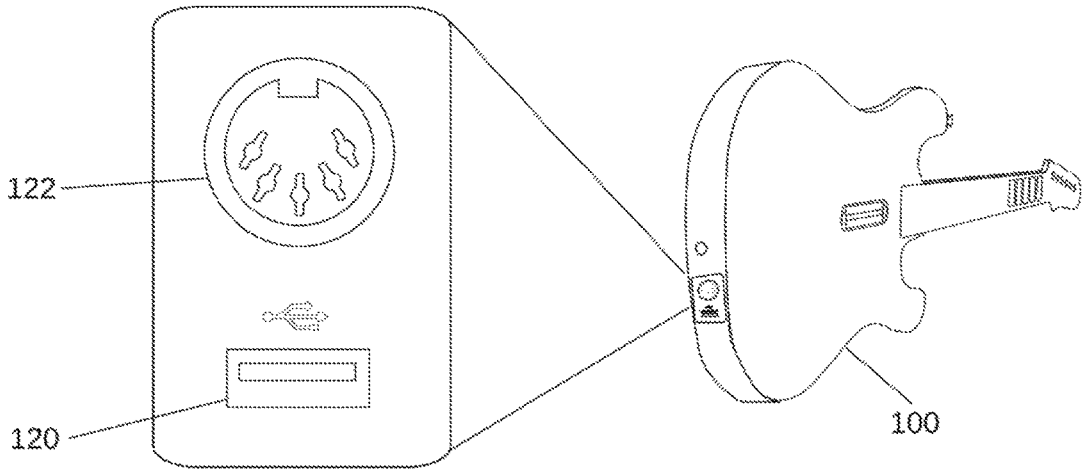
FIG. 1B illustrates a perspective view of the interval-based guitar.

FIG. 1B illustrates a perspective view of the guitar 100, showing the bottom of the guitar 100. The housing includes a USB port 120 and a MIDI port 122. Embodiments of interval-based instruments can also include a Thunderbolt port, a FireWire port, among others. The interval-based instruments can also use WiFi, Bluetooth, ZigBee, or other wireless protocols to communicate with an external device.

Figure 2:
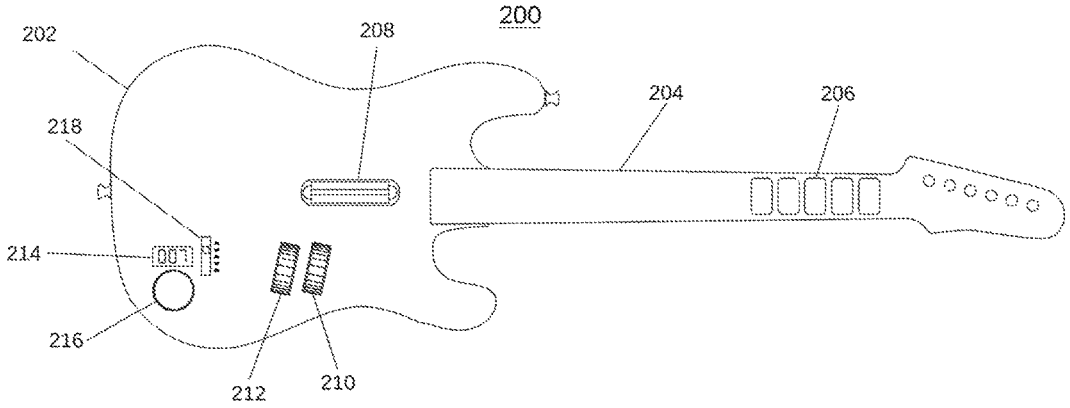
FIG. 2 illustrates a second embodiment of an interval-based guitar with additional features.

FIG. 2 illustrates a second embodiment of an interval-based guitar 200 with additional features. The guitar 200 includes housing 202, neck 204, five buttons 206, and a strum bar 208. The housing also includes a first cylinder knob 210 and a second cylinder knob 212 to control effects applied to the note being played. A digital display 214 displays the status of the guitar, error messages, status messages, and enables the user to configure the guitar 200. For example, the control knob 216 with the digital display 214 can be used to configure sensors and the corresponding effects to generate. Buttons, a touchpad, or other input devices can also be used in place of control knob 216.

The interval-based guitar 200 includes two knobs 210 and 212 to control effects, but alternative embodiments can include less or more knobs to control different effects. Similarly, while the interval-based guitars 100 and 200 include five interval buttons, alternative embodiments can include less than five buttons or more than five buttons. For instance, one embodiment can include one button, another embodiment can include 10 buttons, etc. Embodiments with different number and arrangement of buttons are discussed below.

Figure 3:
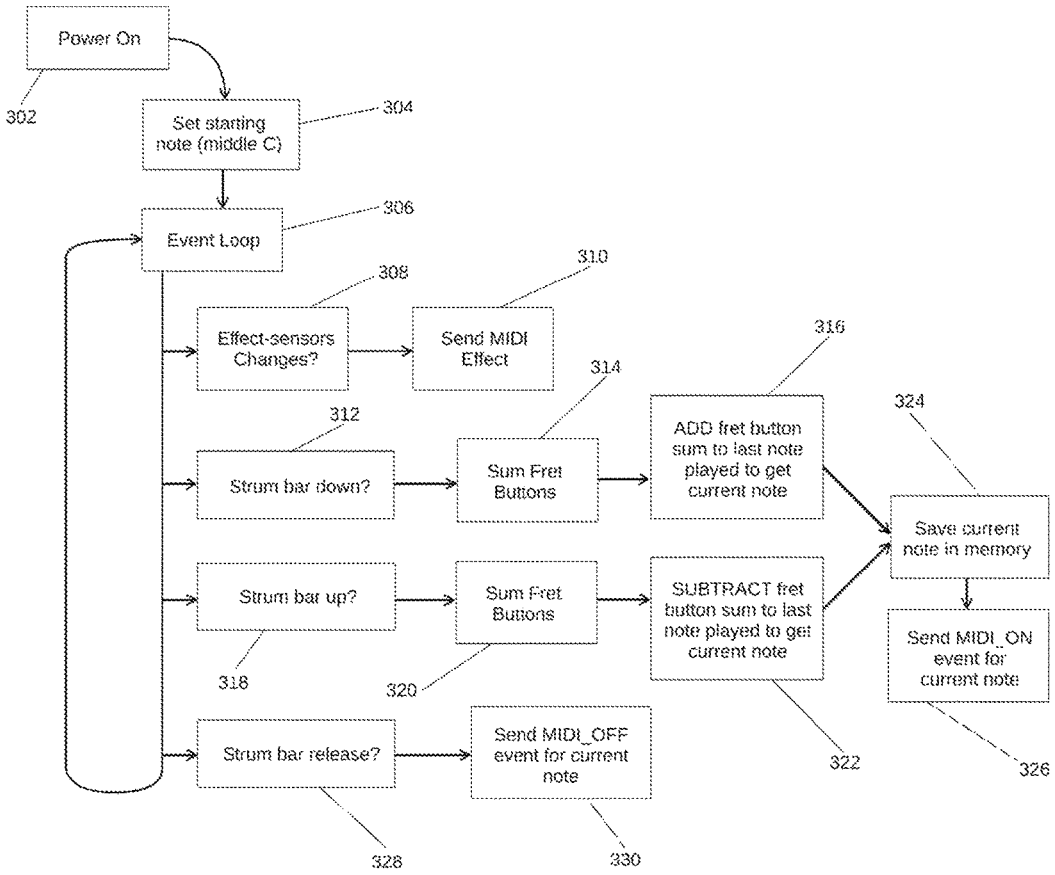
FIG. 3 illustrates a flowchart of the basic operation of an interval-based musical instrument in accordance with an embodiment.

FIG. 3 illustrates a flowchart 300 of the basic operation of an interval-based musical instrument in accordance with an embodiment. The first step 302 is powering on the interval-based guitar. The processor in the guitar then sets the starting note in step 304. For example, the default starting note can be set to middle C or any other note. The choice of the initial starting note can be configured by the user of the interval-based guitar. After setting the starting note, an event loop begins (306). First the processor determines if there are any changes in the sensor readings (308), and if so then a MIDI effect message is sent (310) to an external device, such as a synthesizer, via one of the output ports of the guitar. The event loop then continues by checking whether the strum bar is down (312). If the strum bar is down, then the processor sums the fret buttons that are pressed down (314), and the sum of the pressed fret buttons is added to the last note played in order to get the current note (316). Alternatively, if the strum bar is up (318), the processor sums the fret buttons that are pressed down (320), and the sum of the fret buttons is subtracted from the last note played in order to get the current note (322). The current note is then saved in memory (324), and the processor sends a MIDI_ON event for the current note (326). When the processor detects that the strum bar is released (328), the processor sends a MIDI_OFF event for the current note (330).

Figure 4:
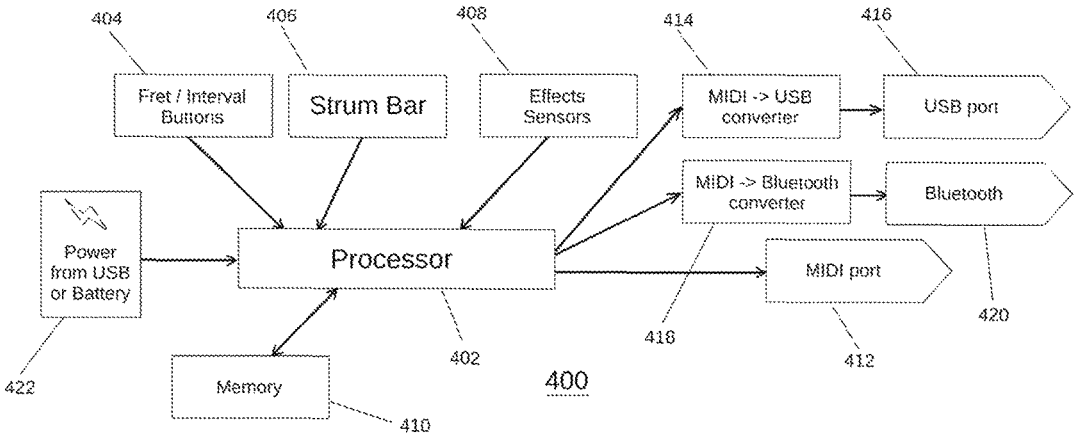
FIG. 4 illustrates a diagram of a circuit in accordance with an embodiment.

FIG. 4 illustrates a diagram of a circuit 400 in accordance with an embodiment. The processor 402 reads the state of the fret buttons 404, the strum bar 406, and the sensors 408. For instance, the processor receives input signals from the fret buttons 404, input signals from the strum bar, and sensor readings from the various sensors 408. The last note played is stored and retrieved from memory 410. The values from the effect sensors 408 are used to generate corresponding MIDI events, as further described in detail below. When the strum bar 406 is pressed, the state of the fret buttons 404 is used to determine the interval that should be added to or subtracted from the last note that was played and stored in the memory 410 to generate the new note. Any suitable sensor or input device which generates analog or digital signals can be used in embodiments.

The values from the effects sensors 408 are received by the processor 402 and converted into MIDI effect events to control the effects of a synthesizer, such as reverb, overdrive, modulation, envelopes, portamento, delay, filters, etc. The output from the processor can be serial MIDI commands transmitted directly via MIDI port 412. The circuit 400 also includes a MIDI to USB converter 414 to convert the MIDI signals to USB, which is then connected to a USB port 416. A MIDI to Bluetooth converter 418 is used to transmit the MIDI signals over Bluetooth 420. Embodiments of the circuit are not limited to a specific number of output ports and modalities. That is, in one embodiment the circuit may have only a MIDI port 412. In other embodiments, the circuit may only output using Bluetooth or only using a USB port. The circuit may also have any combination of output modalities, including a MIDI port, Bluetooth, USB, FireWire, WiFi, Thunderbolt, etc. In alternative embodiments of the circuit, the MIDI to USB converter 414 and the MIDI to Bluetooth converter 418 can be removed, with the processor generating the appropriate output and communicated directly to the USB port, Bluetooth transmitter or WiFi transmitter. The circuit can include include the appropriate interface to output the MIDI signals to various ports or output modalities, including USB, Bluetooth, WiFi, FireWire, Thunderbolt, etc.

The interval-based instrument is powered by a power source 418, which may include power from a USB cable, internal batteries, FireWire, Thunderbolt, etc., or any other power source. For example, USB devices, such as cell phones and computers which have host-mode capabilities, send 5V through the cable to supply power to attached devices. An alternative is to use an internal battery supply that turns on whenever the power button is pressed and that turns off when pressed again or after a period of disuse. The internal batteries can be rechargeable with a corresponding re-charging wall adapter cable or they can be installed separately.

The MIDI port allows interval-based instruments to connect directly to any device that receives MIDI signals, such as hardware synthesizers. Likewise, a USB port allows interval-based instruments to connect to external computing devices such as laptops, computers, tablets, smartphones, IPADs, etc., to send MIDI over USB. As noted above, embodiments can also include Bluetooth or WiFi components that wirelessly send MIDI to external devices.

As described above, MIDI is a technical standard that describes a protocol, digital interface, and connectors allowing a wide variety of electronic musical instruments, computers, and other related devices, to connect and communicate with one another. However, any other protocol to communicate sound data may be used in place of MIDI.

Figure 5A:
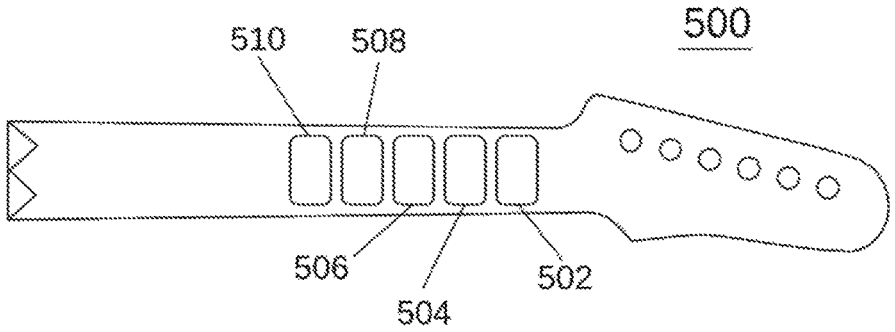
FIGS. 5A-5C illustrate cut, top-down views of different embodiments of the neck of an interval-based guitar with different number and types of buttons.
Figure 5B:
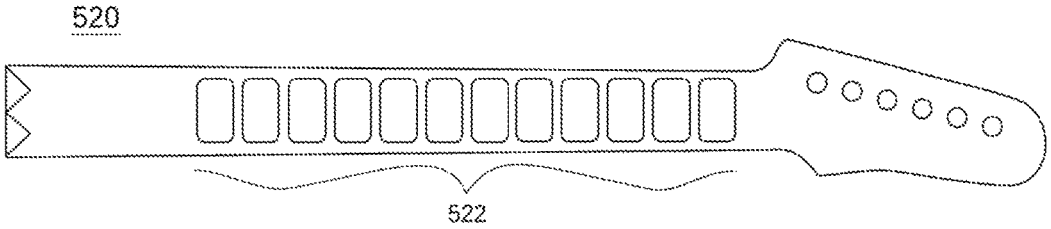
Figure 5C:
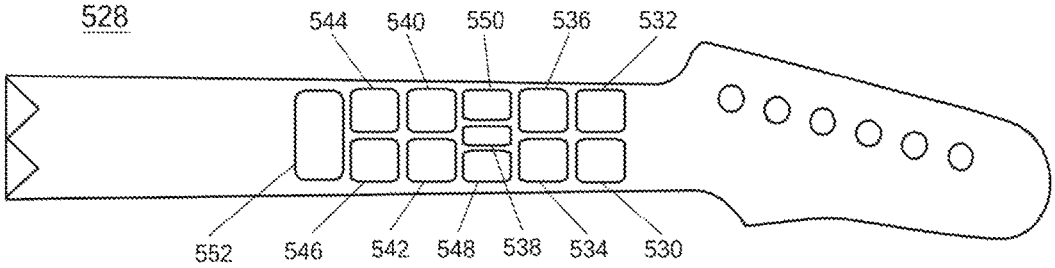

FIGS. 5A-5C illustrate cut, top-down views of different embodiments of the neck of an interval-based guitar with different number and types of buttons. In FIG. 5A the neck 500 includes five fret buttons 502-510. The fret buttons determine the interval distance that the new note will jump from the last note played. Each button represents a number of half-steps, which is the shortest distance between two notes in the Western scale. The first button 502 is one half-step, the second button 504 is two half-steps, the third button 506 is three half-steps, the fourth button 508 is four half-steps, and the fifth button 510 is five half-steps. To make an interval that is greater than five half-steps, multiple buttons can be pressed at the same time and their values are summed. For instance, to make a "perfect 5th", which is seven half-steps (i.e. from C to G), the fourth button 508 and the third button 506 can be pressed simultaneously to make seven half-steps. The same interval can also be made by pressing the fifth button 510 and the second button 504. To make an octave (12 half-steps) the fifth button 510, the fourth button 508, and the third button 506 can be pressed at the same time. The maximum interval that can be made by pressing all five fret buttons simultaneously is 15 half-steps. When no fret buttons are pressed, the interval is zero and the same note will be played as before.

While embodiments are described in terms of the half tone Western scale, and with the buttons being separated by half-steps, it is also possible for the interval-based guitar to be configured to play a different scale, such as the whole tone scale, a quarter tone scale, an Arabic scale, the 17 equal temperament scale, etc. The interval between the buttons need not be a half-step. It can be a whole tone, a semitone, a quarter-step, etc. Not all distances between each button need to be equal. For example, to accommodate a quarter tone scale, an embodiment can include a set of buttons separated by a half-step and one extra button that represents a quarter tone interval.

In one embodiment, the set of all the notes that can be played consists of notes that are spaced apart consecutively by the same interval, such as a half-step for the standard chromatic Western scale or a quarter-step for Eastern scales. Scales that consist of notes that are not spaced apart by the same interval, such as the Major or Minor scales, which consist of notes consecutively separated by either whole steps or half steps, can also be played by embodiments, but the processor does not alter intervals to keep the next note in scales with varying interval distances between consecutive notes. For example, one embodiment has an interval button to choose a minor 3rd and an interval button to choose a major 3rd, but it does not have a button to play a 3rd and have the processor choose whether the 3rd is minor or major in order to keep it in some specified scale, such as the Major scale. This results in simpler, more expressive instruments that are also more challenging to play and require a greater depth of musical knowledge.

The number of fret buttons can be varied, resulting in different embodiments. At least five buttons allow for full interval expression within an octave. With only four buttons, using the summation method described above, the greatest interval that can be indicated is a minor 7th, when all four buttons are pressed at the same time—this excludes the major 7th and octave from the range of expression. More than five fret buttons can also be used to generate different intervals. For instance, FIG. 5B illustrates an embodiment of a neck 520 guitar with 12 fret buttons 522, one button for each of the 12 intervals in an octave.

The fret buttons need not be arranged in a straight line. For example, the buttons can be arranged in two or three rows of buttons on the neck. FIG. 5C illustrates an embodiment of a neck 528 where the intervals are arranged in pairs, with minor or major versions of the 2nd, 3rd, 6th, and 7th. The buttons are arranged two side-by-side for each of the paired intervals, one for the major version and one for the minor. Button 532 plays the major version of the 2nd, whereas the pair button 530 plays the minor version of the 2nd. Buttons 536 and 534 play the major and the minor version of the third, respectively. Buttons 540 and 542 play the major and the minor version of the 6th, and buttons 544 and 546 play the major and the minor version of the 7th. Button 548 plays the perfect 4th, button 538 plays a tritone, button 550 plays a perfect 5th, and button 552 plays an octave (perfect 8th).

Instead of pairs of buttons, the instrument can include single buttons that can be moved to either side. In some embodiment, the buttons may also sense the force of the press. For example, minor versions of the interval can be played when the button is pressed lightly and major versions of the interval can be played when the button is pressed harder.

In some embodiments, the fret buttons can include labels, making it easier for certain users to identify what each button does. This can be especially useful when the instrument includes a large number of buttons. As described further below, the user can also configure the tone or interval played by each button.

In some cases, a melody requires a jump with an interval distance greater than 14 half-steps. Embodiments can include a button that represents 12 half-steps, or an octave. The button can be located near the strum bar, to be pressed with the strumming hand. The button can also be located on the neck of the interval-based guitar, to be pressed by the thumb of the fret hand. When an octave button is held down, 12 half-steps are added to the sum of the other fret buttons. If there is an octave button on both the neck and the body of the device, the interval distance that can be jumped by pressing both octave buttons and the frets is over three octaves. It is to be understood that any other suitable position of the octave button on the body of the guitar or the neck is also possible in embodiments.

Embodiments can be used for playing melodies. Embodiments can include harmony buttons that play notes in harmony with the melody note that is being played. These harmony buttons can be added to the neck of the interval-based guitar, near the interval frets (to be pressed by the interval selection hand), or near the strum bar (to be pressed by the extra fingers of the strumming hand).

For example, one embodiment can include a low minor 3rd harmony button. When pressed, this button plays a note that is a minor 3rd below the current note of the melody note. Embodiments can also include one harmony button for each interval within the reach of an octave. Alternatively, harmony buttons can be included for popularly used intervals, such as the 3rds, 4th and 5th. Separate harmony buttons can be pressed simultaneously to create three or more note harmonies.

Pianos have sustain pedals that, when pressed, prevent the piano from muting any notes that have been played since the pedal was pressed. This feature can be implemented in embodiments through a sustain button located near the strum bar, though it can also be positioned anywhere in the body or on the neck of the guitar. When pressed, a MIDI sustain ON command is sent. When released, a MIDI sustain OFF is sent. Alternatively, the notes played while the sustain button is pressed can be stored in the processor's internal memory; individual MIDI note ON commands can be sent when each note is pressed, and MIDI note OFF commands for each sustained note in memory can be simultaneously sent when the sustain button is released.

Figure 6A:
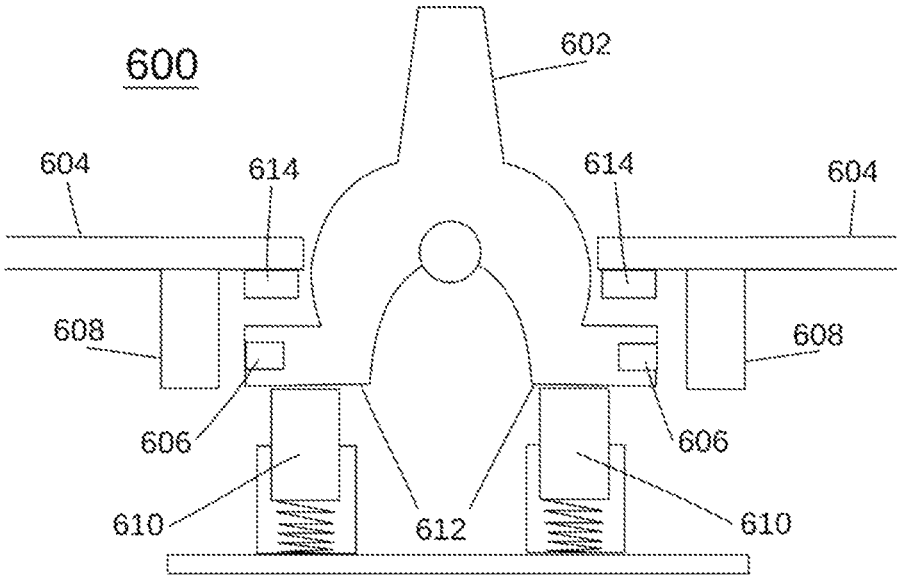
FIG. 6A illustrates a cross-sectional view of a strum bar in accordance with an embodiment.

FIG. 6A illustrates a cross-sectional view of a strum bar 600 in accordance with an embodiment. The strum bar 600 projects out from an opening in the body 604 of the interval-based instrument. The strum bar 600 includes a bar 602, magnets 606, magnetic sensors 608, and spring buttons 610. When a force is applied to the bar 602, the magnets 606 move away from the magnetic sensors 608, allowing the processor of the musical instrument to detect that the bar 602 is being strummed. When the bar 602 moves further, it triggers a spring button 610. By measuring the time between the change in the magnetic sensors 608 and the trigger of the spring button 610, the velocity of the bar 602 is calculated, which is used to determine the volume of the note that will be played. When the bar 602 is released, the magnets 606 will again align with the magnetic sensors 608, which indicates that MIDI_OFF should be sent for the currently playing note.

In the released state of the bar 602, the spring buttons 610 touch the bottom 612 of the strum bar 602, which provide a slight force to keep the bar 602 centered until pressed. By pressing further down on the strum bar 602, the force sensor 614 is compressed. This trigger can be used to generate MIDI effects such as aftertouch for the currently playing note. The force sensor 614 can consist of a springy resistive foam. However, it can also consist of force sensitive resistors, linear potentiometers, or some other electronic component that provides physical resistance and measures compression distance or force.

Figure 6B:
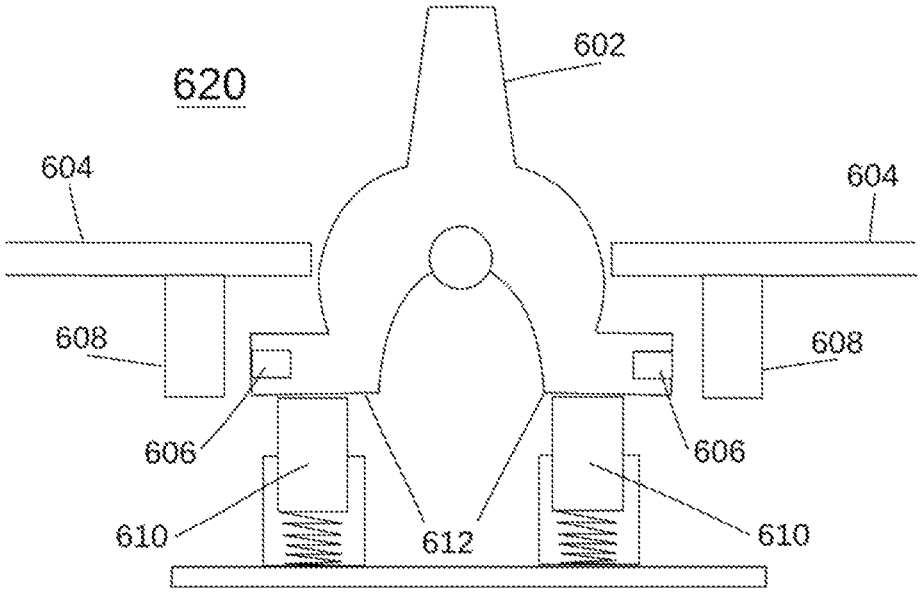
FIG. 6B illustrates a cross-sectional view of a strum bar without force sensors.

FIG. 6B illustrates a cross-sectional view of an alternative strum bar 620, which does not include force sensors 614. Embodiments are not limited to the strum bar examples presented in FIGS. 6A-6B. What is important is for the strum bar to include at least two modes to enable the user to play a note by moving the melody by a particular interval either up or down from the previous note. In one embodiment, the strum bar can be replaced with a sensor having two threshold values. The first threshold can represent moving the strum bar up, and the second threshold can represent moving the strum bar down. Detecting that the sensor value is above the first threshold, causes the processor to generate a new note by adding the interval to the previously played note. For example, the processor can send a MIDI_ON event for the new note. When the sensor value is below the first threshold, then the processor can send a MIDI_OFF event for the new note. Similarly, when the sensor value is below the second threshold, the processor can generate a new note by subtracting the interval from the previously played note. When the sensor value is above the second threshold, then the processor can send a MIDI_OFF event for the new note.

Figure 7A:
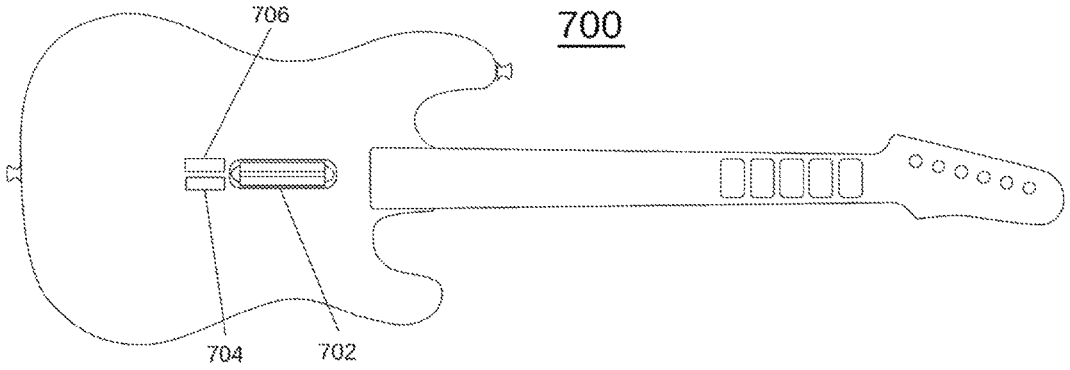
FIG. 7A illustrates an embodiment of an interval-based guitar which includes a strum bar, a play up button, and a play down button.

The most essential function of the strum bar is to indicate when to play a note and whether to move the melody to a higher or lower pitch. That is, the strum bar indicates when to play a new note, and whether the pitch of the new note will be higher or lower in frequency by some interval amount than the previous note. This can be accomplished in many different ways other than using a strum bar or paddle. In one embodiment, the strum bar can be replaced with two buttons: a first button to play up and a second button to play down. Pressing the play up button can be equivalent to moving the strum bar up, while pressing the down button can be equivalent to moving the strum bar down. In yet another embodiment, the guitar can include both the strum bar and these two play up/play down buttons. These buttons can then be used in conjunction with the strum bar to allow musicians to choose their preferred method of input. For instance, a musician may wish, for a particularly fast passage of music, to switch to tapping the buttons rapidly rather than moving the strum bar up and down. FIG. 7A illustrates a guitar 700 which includes a strum bar 702, and a play up button 704, and a play down button 706.

Figure 7B:
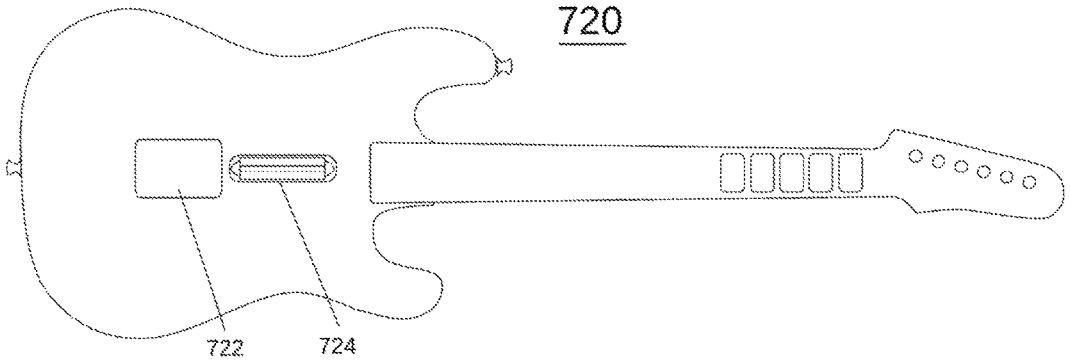
FIG. 7B illustrates an embodiment of an interval-based guitar with both a touchpad and a strum bar.

In yet another embodiment, the strum bar can be replaced with a touch screen or a touchpad that reads the direction of the musician's finger swipes or gestures across the surface of the touch screen or touchpad. Effects such as note volume can be determined by the velocity of the swipe, or other effects such as overdrive might be indicated by the position of the swipe on the touchpad. Similar to the embodiment in FIG. 7A, the play up button 704 and the play down button 706 can be included in the body of a guitar in addition to the touchpad. FIG. 7B illustrates a guitar 720 with both a touchpad 722 and a strum bar 724. A touchscreen can also be used in place of the touchpad. In embodiments that use velocity sensitivity, the change in time between two user inputs (a first user input and a second user input) can be used to determine the velocity, though alternative methods for calculating velocity are possible.

In yet another embodiment, a three way rocker switch can be used to indicate the three states of up, down, and neutral (released). This is equivalent to moving the strum bar up (up state), moving the strum bar down (down state), and releasing the strum bar (neutral or released state). An analog control device can also be used to indicate these three states, but with the input also specifying the volume for the new note.

Figure 8A:
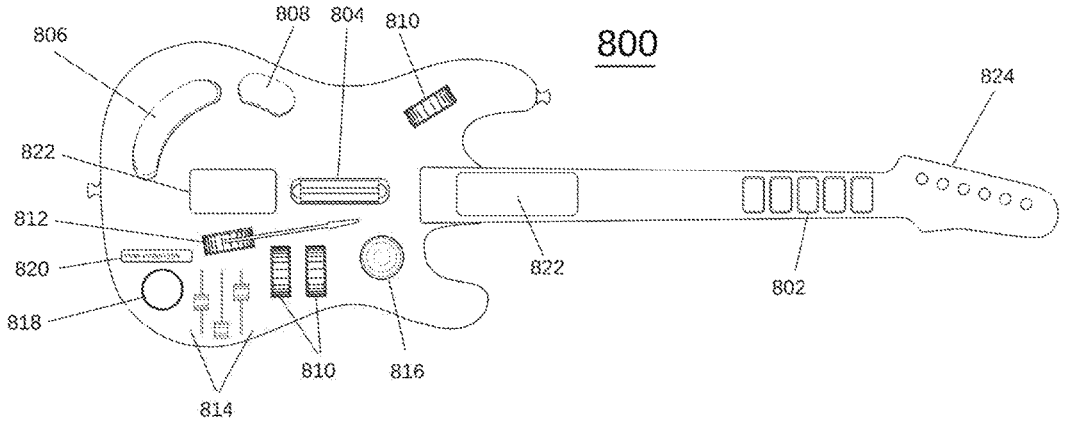
FIGS. 8A-8F illustrate an embodiment of an interval-based guitar including multiple sensors for controlling MIDI effects.

Multiple sensors can be added to embodiments for dynamically controlling MIDI effects. FIG. 8A illustrates an embodiment of a guitar 800 including multiple sensors for controlling MIDI effects. The guitar 800 includes fret buttons 802 and a strum bar 804. The body of the guitar 800 includes a sustain button 806, an octave button 808, wheel sensors 810, a whammy bar 812, sliders 814, trackball 816, effects configuration knob 818, display 820, and a two touch sensor or touchpads 822 (one in the body and one in the neck of the guitar). While these multiple sensors, with the exception of the touch sensor 822, are illustrated on the body of the guitar 800, in alternative embodiments these sensors can either be in the body or in the neck of the guitar. Some of these sensors can also be included in the back of the body of the guitar 800, anywhere along the neck of the guitar, on the head 824 of the guitar, and even on the sides of the guitar. In addition, any one of these sensors can be combined resulting in different embodiments. For instance, one embodiment of a guitar may include only the strum bar 804, the fret buttons 802, and the sliders 814, while a second embodiment of a guitar may include the strum bar 804, the fret buttons 802, and the whammy bar 812.

Figure 8B:
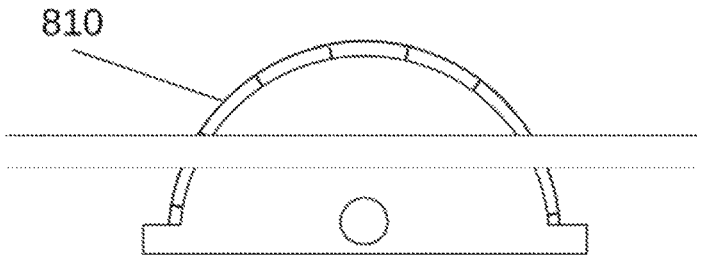

FIG. 8B illustrates a cross-sectional view of a wheel sensor in accordance with an embodiment. Wheels are narrow half-cylinders that can be rotated back and forth. Their rotation is somewhat stiff so that they do not change unless intended. They rotate approximately 90 degrees. A finger should be able to move the wheel its whole range without lifting to reposition. In the guitar 800, they can be placed below the strum bar 804 so that the fingers of the strumming hand can change their position while still strumming. A wheel sensor can either be the type that remains static when released or it can be the type with springs that motivate its rotation back to its starting point, which could either be in the middle or on one side.

Figure 8C:
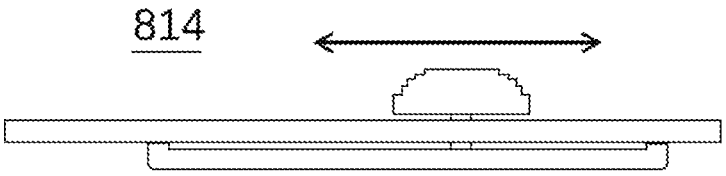
Figure 8D:
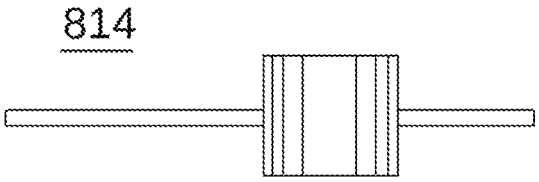
Figure 8E:
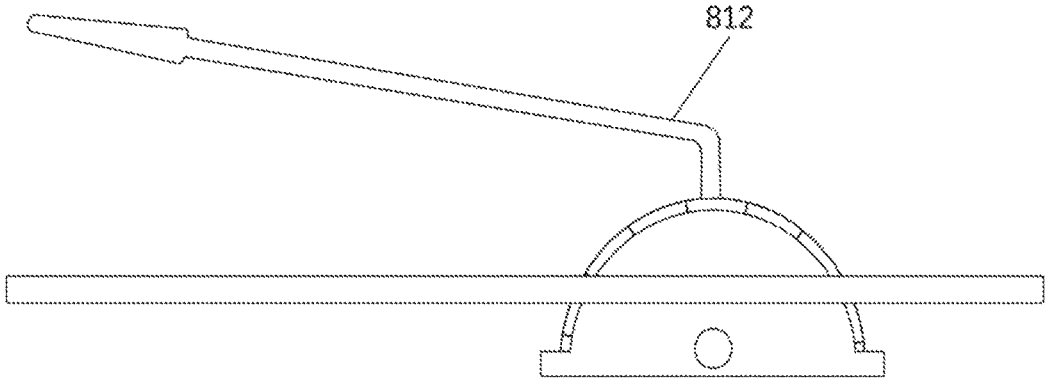
Figure 8F:
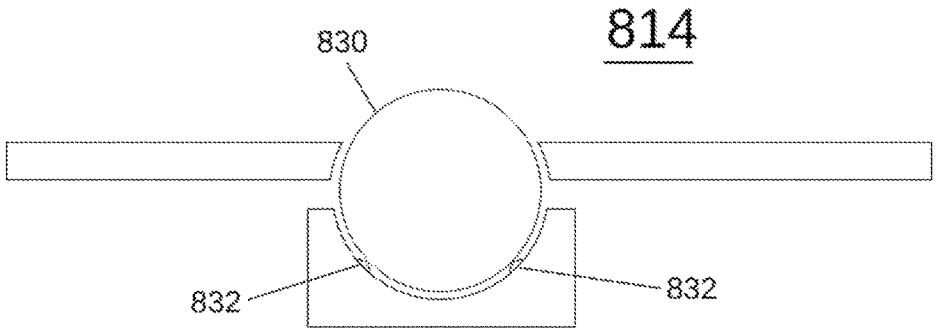

FIGS. 8C and 8D illustrate a side-view and a top-down view, respectively, of a slider 814 in accordance with an embodiment. Sliders, which are commonly used on many audio mixing boards, move linearly on a rail. The percentage distance across the rail determines the quantity of the effect it controls. FIG. 8E illustrates an embodiment of a whammy bar 812. A whammy bar is a wheel with a protruding bar. The musician moves the bar up and down to control the wheel's rotation. A spring in the wheel resists the movement of the bar and returns the bar to the starting position when no external force is applied. FIG. 8F illustrates an embodiment of a trackball 816. The trackball consists of a ball 830 that can be rotated in place in any direction and at any angle. Its horizontal and vertical movements are measured by two rolling sensors 832 that touch the side of the ball 830. The top of the ball 830 is accessible to the musician, who can move it in any direction at various speeds to control effects.

Figure 9:
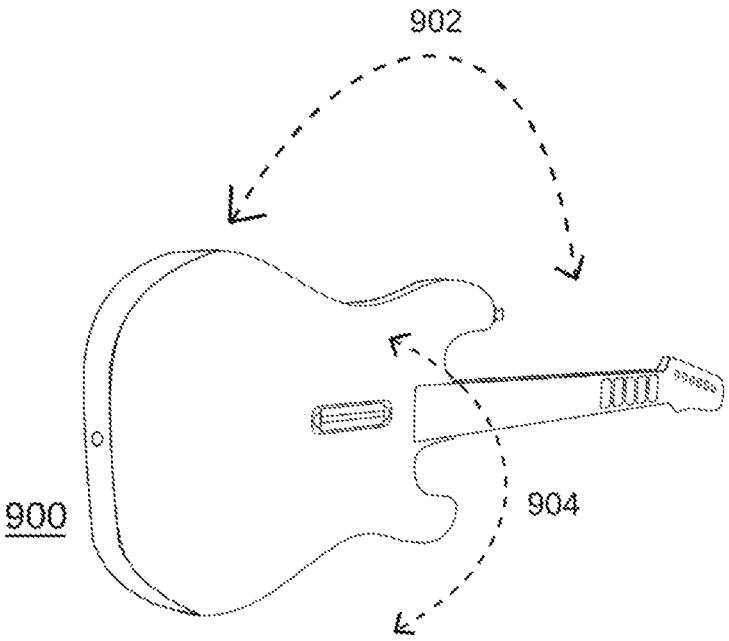
FIG. 9 illustrates an embodiment of an interval-based guitar with two tilt sensors, with one of the tilt sensors detecting the angle of the neck from the ground, and another tilt sensor detecting the front/back tilt of the body of the guitar.

In one embodiment, tilt sensors can be included in an interval-based instrument to detect the tilt of the instrument, and thus cause an effect on the note being played. FIG. 9 illustrates a guitar 900 with two tilt sensors (not illustrated), with one of the tilt sensors detecting the angle of the neck from the ground along direction 902, and another tilt sensor detecting the front/back tilt of the body of the guitar along direction 904. One or more tilt sensors can be included to detect the tilt of the guitar along multiple axis, with this causing an effect on the note being played. For example, tilting the guitar may cause the interval to change from a minor to a major, cause the note to be amplified in volume, change a low pass filter effect, modify a tremolo effect, toggle sustain, etc. Instead or in addition to tilt sensors, the guitar can include or use accelerometers, a compass, and/or gyroscopes to detect linear and circular movements of the guitar and the angle of orientation of the guitar.

Figure 10:
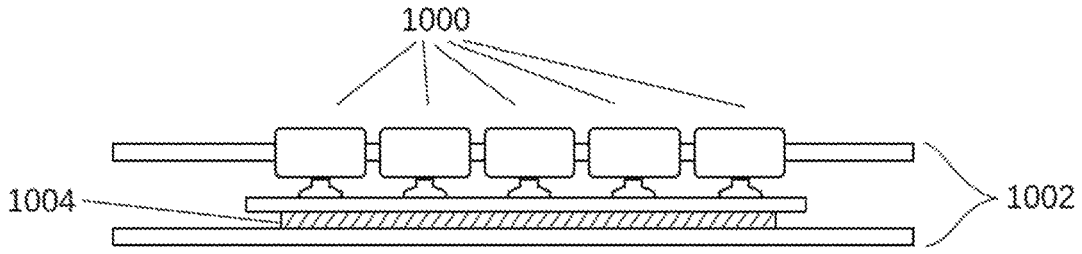
FIG. 10 illustrates a cross-sectional view of five fret buttons in the neck of an interval-based guitar in accordance with an embodiment.

A force sensor detects the amount of pressure applied to it. In one embodiment, a force sensor can be added to the strum bar, as shown in FIGS. 6A-6B, for aftertouch effects. Another force sensor can also be placed as a strip beneath the fret buttons to detect how hard the frets are being pressed. For example, this can be used as a pitch-bend to produce vibrato, to control an overdrive distortion effect, or hard presses can add an octave to whatever interval is specified by the fret buttons. FIG. 10 illustrates a cross-sectional view of five fret buttons 1000 in the neck 1002 of a guitar. The force sensor 1004 beneath the fret buttons 1000 can detect how hard the buttons are being pressed.

Any type of sensor can be included in order to create variations of musical instruments, enabling instruments to be customized to different types of users and different applications. For instance, light sensors that detect the amount of light that reaches their surface, can be placed in various locations on the instrument. By moving a hand over the sensor, the light can be diminished and the effect changed.

Figure 11:
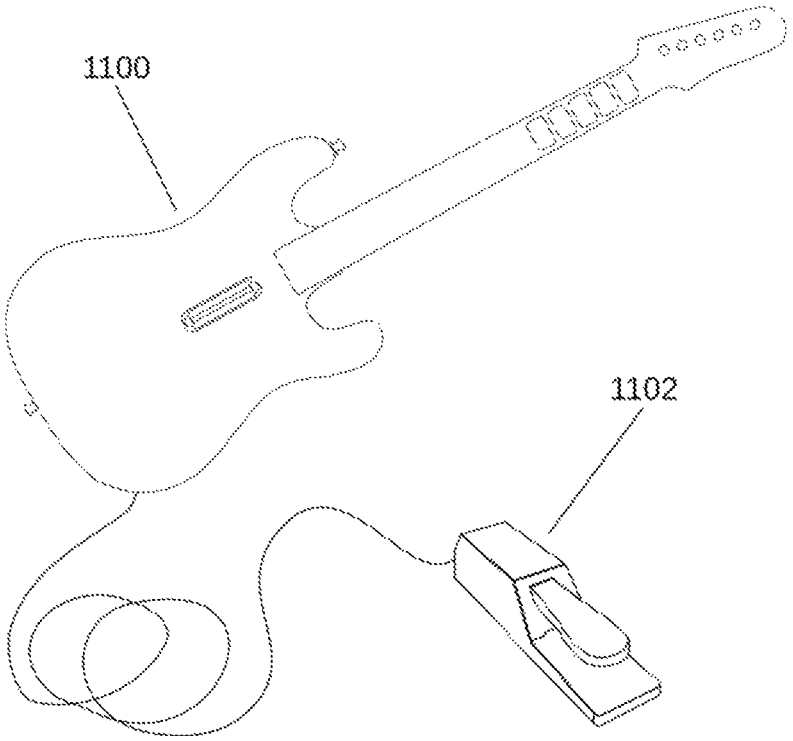
FIG. 11 illustrates an embodiment of an interval-based guitar connected to a foot pedal acting as an external sensor.

The embodiments described herein are not limited to internal sensors. In one embodiment, the guitar can connect to one or more external sensors. FIG. 11 illustrates a guitar 1100 connected a foot pedal 1102 which acts as an external sensor. The guitar can include one or more input jacks to connect to one or more external sensors, such as foot pedals. The input from the external sensor can be received by the processor in the interval-based instrument and used to apply an effect to the note being played. External effects also enable the synchronization of effects between multiple instruments by, for instance, connecting them all to a central controller.

The rotational knob and digital display, such as rotational knob 216 and display 214 or knob 818 and display 820, allow the user to scroll through a list of sensors, effects, and configuration options, to pair each sensor with an effect and to calibrate its range. The knob can be rotated to cycle through a list of sensors on the display. For example, if an interval guitar includes strum bar force sensors, two tilt sensors, two wheel sensors, and a fret button force sensor, then all of these sensors would be listed on the display. Any sensor of the instrument can be configured, including the whammy bar, the light sensor, the touch screen, etc. After selecting a sensor, the list of effects available for a particular sensor can be shown on the display, with the knob used to cycle through these effects on the display. MIDI effects that can be specified include change volume, pitch bend, filter cutoff frequency, MIDI aftertouch, distortion, overdrive, dynamics, filter, modulation, pitch, time-based, feedback/sustain, delay, tremolo, overdrive, wah, chorus, reverb, phaser, octaver, etc. Effect chains can also be formed.

After selecting an effect, the user can set a low threshold, a high threshold, or both a low and a high threshold, with these thresholds indicating the point at which the effect should be activated and deactivated during play. For example, if the low threshold is set, then the effect will be activated only when the value generated by the corresponding sensor is at or below the low threshold. Similarly, if the high threshold is set, then the effect would be activated during play when the value generated by the corresponding sensor is at or above the high threshold.

The effect values actually sent when the corresponding sensor is below the low threshold or above the high threshold can then be set by the user. For example, the user can specify a value between 0 and 127, which represents the value to send when the corresponding sensor has a value below the low threshold described above. The value specified by the user, referred to as an "effect-low value," represents the value to send when the corresponding sensor is at or below the low threshold. Similarly, the user can specify an "effect-high value," the value to send when the corresponding sensor has a value above the high threshold described above. This also can be a value range between 0 and 127. While playing a note, if the sensor is moved between the sensor-low threshold and the sensor-high threshold, one or more MIDI effect messages can be generated with values across a linear range between the effect-low value and the effect-high value. By allowing the user to set high and low ranges for both the sensor (high threshold and low threshold) and their corresponding effects (effect-high value and effect-low value), it enables a great variety of configurations and even the inversion of effects. This is useful because each synthesizer interprets MIDI effects differently. Also, for some sensors, such as the left-right tilt, the user may not wish for an effect to increase until it reaches a certain point, such as when the neck of the guitar is raised past 45 degrees.

The value range need not be from 0 to 127. The value range can be between any two numbers. For example, the value range may be between 1 and 5, 1 and 100, etc. These exact values can be sent, or the values can be transformed to other values before being sent. Alternatively, instead of specifying numeric values, the user may see labels such as "Strong", "Medium", "Weak", or any other suitable labels, with these labels automatically mapped to particular numeric values.

The sensor and effects configuration are saved in persistent memory in the processor so that the configuration will be stored while the device is without power.

While it is possible for a user to configure the activation of an effect based on a sensor value, this is an option for users interested in a high level of control over the behavior of the interval-based instrument. This high level of configuration would allow an ordinary user, without software or hardware programming experience, to customize the interval based instrument by just using the configuration menu. However, embodiments also support a simpler configuration for novice users, where a user simply matches an effect with a particular sensor (such as the whammy bar), and the processor selects and saves the necessary settings (such as the high threshold, the low threshold, the effect-high value, the effect-low value).

Embodiments can include a touchscreen on the instrument, or can communicate with an application on an external device, with the configuration display all being done on the external device. The external device may be any device with a screen that can connect to the instrument via WiFi, Bluetooth, via a direct USB connection, or via an alternative interface or cable. For example, the external device can be a smartphone, tablet, or computer.

In one embodiment, a touchscreen configuration menu can be provided either on the application running on the external device or on a touchscreen in the interval-based instrument. The sensors can be displayed using a list, or they can be represented with icons, with each icon being a simplified picture of the corresponding sensor. This screen can allow the user to select an effect to be associated with a sensor, the effect minimum and maximum range (effect-low value and effect-high value), and the sensor minimum and maximum range (low threshold and high threshold).

A set of configuration settings can be saved to a file and configuration settings can be loaded from a file. This allows a musician to have separate configurations for different synthesizers. For example, one configuration can be for using an instrument with an application on the computer. Another configuration can be for using the instrument with an application on a smartphone, IPAD, tablet, smartwatch, or other portable device. Yet another configuration can be for using the musical instrument with a specific analog synthesizer. The saving and loading of configuration settings to/from a file allows configurations of an instrument to be shared among users. It also allows configurations to be deployed to a wide range of users. The instrument can also include various default configurations, allowing a user to select among one of the default configurations without having to manually configure every possible setting in the instrument.

In one embodiment, instead of relying on an external MIDI synthesizer, the interval-based musical instrument can include an internal synthesizer that generates the audio for each note. A built-in synthesizer can generate a simple wave, such as a triangle or square wave. The built-in synthesizer can also generate a variety of different types of sounds that mimic other musical instruments or generate sounds unique to electronic synthesizers. The audio outputs from the internal synthesizer can output through an audio jack (which can be connected by cable, like an electric guitar) to a speaker or amplifier. Embodiments can also include an internal speaker to audibly play the sound generated by the internal synthesizer.

In one embodiment, the musical instrument can record the notes that the musician has played, store them in internal memory, and play them back when a button is pressed. The playback can be set to loop repeatedly so that the musician can play and record, for instance, a bass line, then improvise a melody on top of the pre-recorded bass line. In this embodiment, the interval-based instrument can include a record button which indicates to the processor that the new notes are to be saved in memory for playback. A play button can then retrieve the notes from the memory and play them. A clear button can clear the notes from memory, or pressing the record button can also automatically clear any prior notes from memory.

Figure 12A:
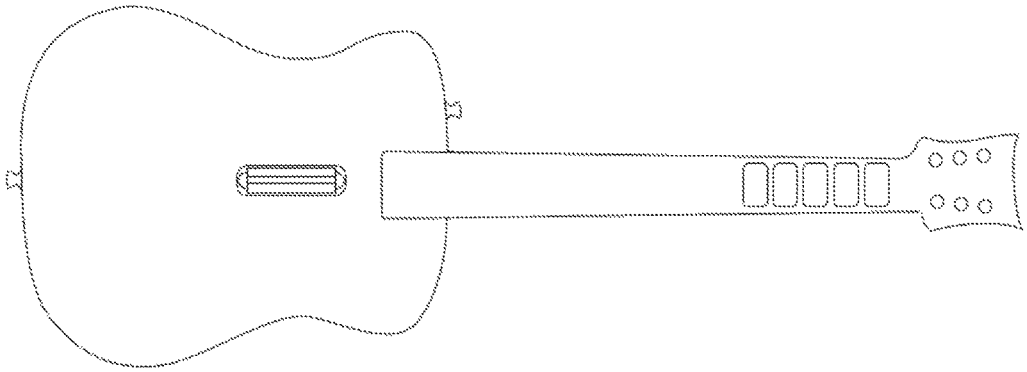
FIG. 12A illustrates an embodiment where the interval-based instrument is shaped like an acoustic guitar.
Figure 12B:
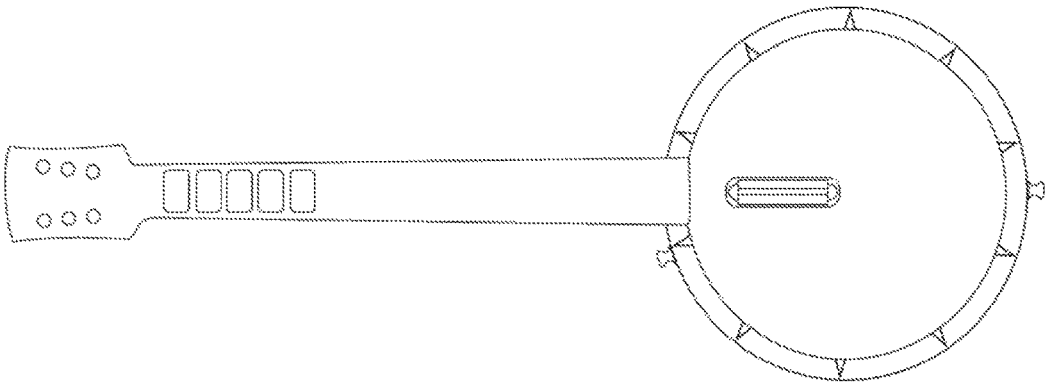
FIG. 12B illustrates an embodiment where the interval-based instrument is shaped like a banjo.
Figure 12C:
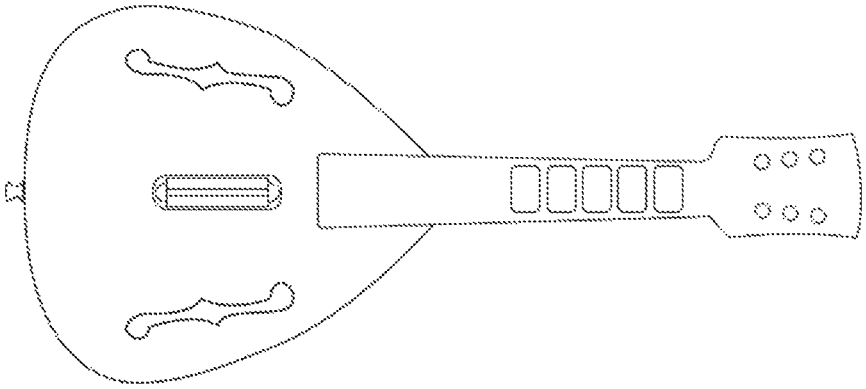
FIG. 12C illustrates an embodiment where the interval-based instrument is shaped like a mandolin.

Embodiments of instruments described herein are not limited to being shaped like a guitar. Embodiments can also be made out of a variety of materials—plastic, wood, metal, etc. What is important is that the instrument lets the musician conveniently select an interval and indicate that it should be played higher or lower than the previous note that has been stored in the memory of the instrument's internal circuit (or external memory in some embodiments). Apart from the wide variety of electric guitar shapes, the invention can imitate other fretted stringed instruments, such as an acoustic guitar, banjo, bass guitar, or mandolin, etc. FIG. 12A illustrates an embodiment where the instrument is shaped like an acoustic guitar. FIG. 12B illustrates an embodiment where the instrument is shaped like a banjo. FIG. 12C illustrates an embodiment where the instrument is shaped like a mandolin.

Figure 13A:
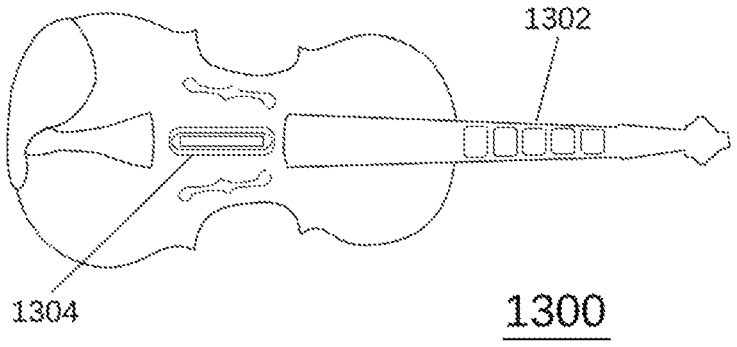
FIG. 13A illustrates an embodiment where the interval-based instrument is shaped as a violin.
Figure 13B:
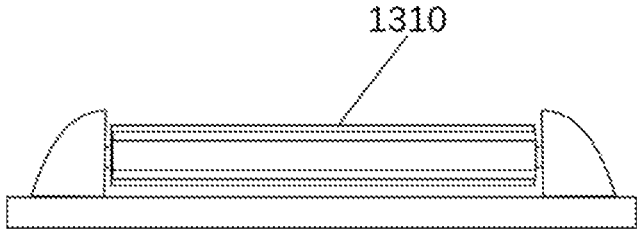
FIG. 13B illustrates an alternative strum bar consisting of a rolling cylinder or a string that detects the direction of a bow movement to indicate the direction of the interval in the melody.

Embodiments can also be shaped as violins, violas, and cellos. FIG. 13A illustrates an embodiment shaped as a violin 1300. The interval-based violin includes fret buttons 1302 and a strum bar 1304. FIG. 13B illustrates a side-view of an alternative strum bar consisting of a rolling cylinder 1310 that detects the direction of a bow (not illustrated) movement to indicate the direction of the interval in the melody. The vibrations caused by the bow across the cylinder 1310, or the speed of the bow across the rotating cylinder 1310, can be used to manipulate the expression of the note through the synthesizer, controlling volume, tone, etc. Also, instead of pairing up and down bow movements to melody direction, the direction of the bow movement can be ignored and another sensor can indicate up or down movement, such as a button on the bow or a force sensor strip in the neck. For example, a harder squeeze on the neck can move the melody down and a lighter touch can move it up. A string can also be used instead of the rotating cylinder 1310.

Figure 14:
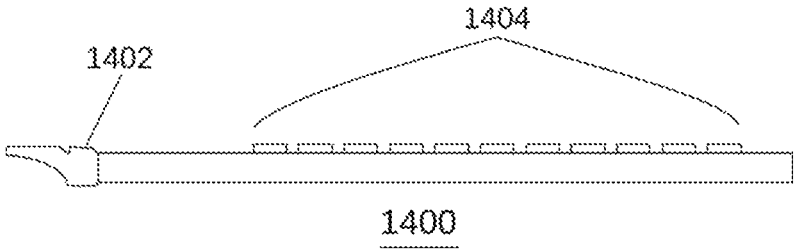
FIG. 14 illustrates an embodiment of an interval-based instrument shaped like a flute.

A sensor that detects the direction and magnitude of the movement of air can be used in place of the strum bar to determine the direction and volume of the next note. This can be used for flute-like or recorder instruments, where the musician can press buttons along the flute shaft to indicate the interval and blow out or suck in to indicate the direction of the melody. A feature like the octave button, which adds an octave to whichever interval is indicated by the interval buttons, can be implemented by measuring the force of passing air through the flute. A greater force can, as in a real flute, cause an octaval jump. The tone and volume of the notes being played can be modified by the rate of airflow. The direction of the interval movement can instead be determined by a separate button. This button can be placed on the bottom of the instrument. FIG. 14 illustrates a side-view of an example embodiment shaped like a flute. The flute 1400 includes a mouthpiece 1402 and buttons 1404 to indicate the interval by which to increase or decrease the previous note.

Figure 15:
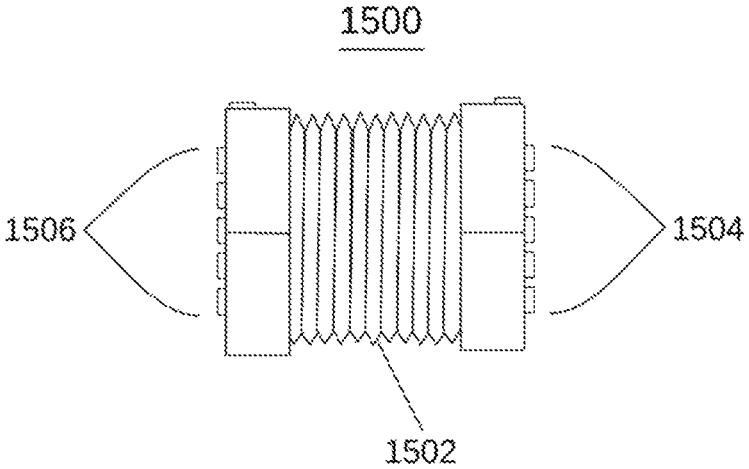
FIG. 15 illustrates an embodiment of an interval-based instrument shaped like a concertina or an accordion.

An embodiment can be shaped like a concertina, an accordion, a bandoneon, or other squeezebox instruments. FIG. 15 illustrates an embodiment shaped like a concertina. The concertina 1500 includes bellows 1502 and buttons 1504 and 1506 on both sides of the instrument. This embodiment uses the direction of airflow—squeezing in or pulling out—to determine melodic direction, and buttons 1504 and 1506 on the sides of the instrument to determine the magnitude of the next interval. The embodiment can include interval buttons on one side and harmony buttons on the other side.

Instead of harmony buttons, interval buttons can also be included on both sides to enable the instrument to play two simultaneous melodies, not necessarily related. In this case, buttons on the side of the instrument, controlled by the thumbs, can indicate the melodic direction for either side. For instance, pressing the left button can indicate that the interval is to be added to a prior note to generate a new note, whereas not pressing the left button can indicate that the interval is to be subtracted from the prior note to generate the new note. Alternatively, the left side can include both an up button and a down button to indicate melodic direction. Pressing the up button can indicate to change the pitch of the prior note by adding the interval to the prior note, and pressing the down button can indicate to change the pitch of the prior note by adding the interval to the prior note. Similarly, the right side can include a single up/down button, or an up button and a down button to indicate melodic direction for a different prior note to generate simultaneously a new note that is different than the new note generated with the buttons on the left side.

In the concertina or any squeezebox embodiment, a sensor within the bellows can detect a change in air pressure or a change in the direction of air flow. The sensor can be a pressure sensor, an airflow velocity sensor, or any other device to detect pressure changes or air flows within the bellows. For instance, when the bellows are pressed, this can determine that the interval is to be added to the prior note to generate the new note, whereas the bellows expanding can determine that the interval is to be subtracted from the prior note to generate the new note, or vice-versa.

Figure 16:
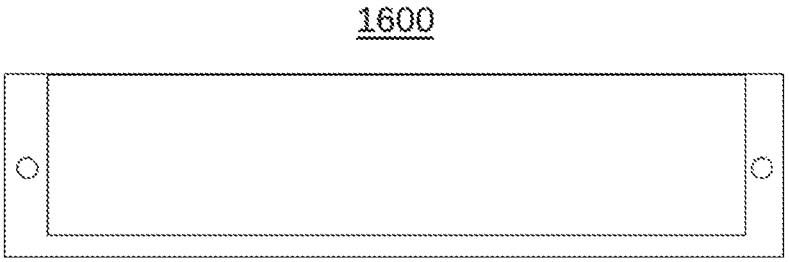
FIGS. 16 and 17 illustrate an embodiment of an interval-based instrument shaped like a harmonica.
Figure 17:
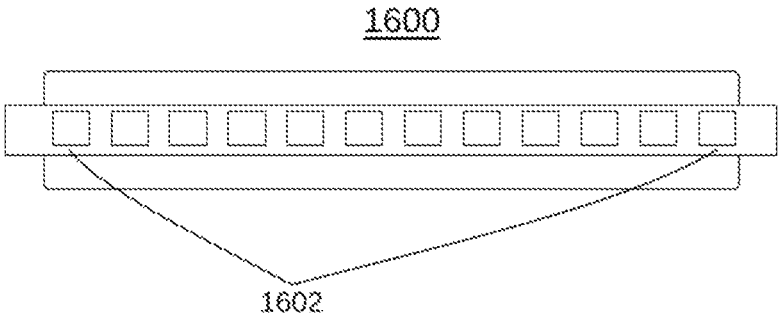
Figure 18:
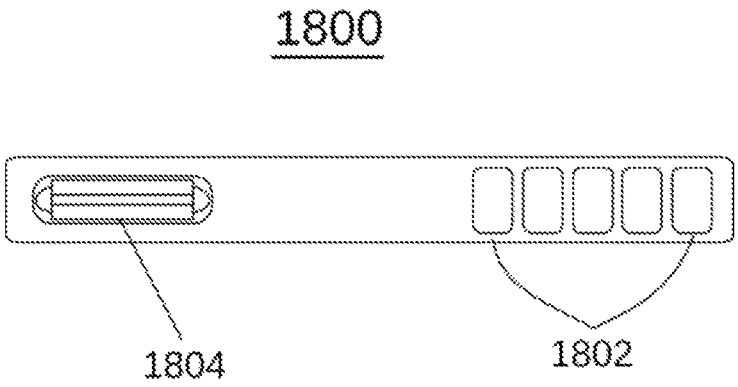
FIG. 18 illustrates an embodiment of an interval-based instrument shaped like a rectangular stick with a strum bar and fret buttons.

FIGS. 16 and 17 illustrate an embodiment shaped like a harmonica 1600. FIG. 16 illustrates a top-down view of the harmonica embodiment. FIG. 18 illustrates a front-view of the harmonica embodiment. A harmonica-like interval instrument includes blowholes 1602, each corresponding to an interval. The direction of airflow through a hole—blowing in or sucking out—detected by a sensor inside the hole, determines the direction that the melody jumps by that hole's interval. The velocity of the airflow can control volume. In one embodiment, squeezing the body of the harmonica can add an octave to the interval to be added or subtracted from the prior note to generate the new note. A force sensor can be used to detect the squeezing of the harmonica. Alternatively, one or more buttons on the body of the harmonica can be used to add the octave to the interval or to apply different MIDI effects to the new note.

FIG. 18 illustrates an embodiment of a stick shape instrument 1800. A minimalistic stick shape can be useful for travelling musicians. It consists of a long neck with the interval buttons 1802 near the top and the strum bar 1804 near the bottom. The stick shape has a substantially rectangular shape. In another embodiment, the neck can telescope so that it can fit more easily into a purse or backpack, yet still extend to a comfortable length when playing.

Figure 19:
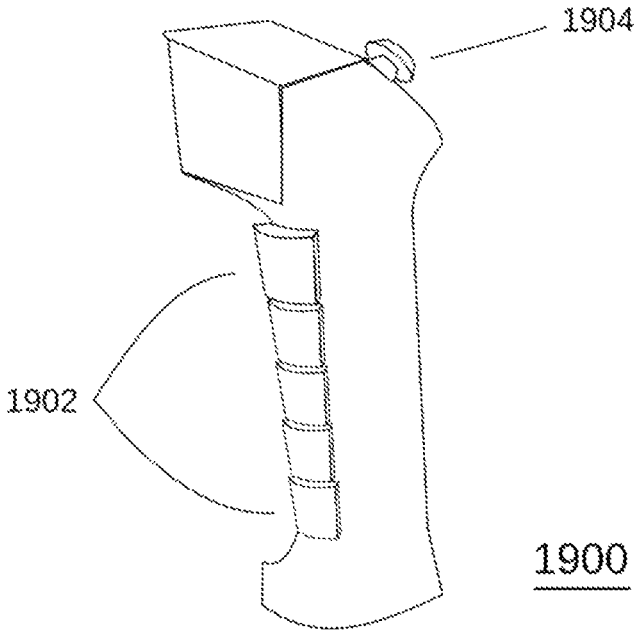
FIG. 19 illustrates an embodiment of a hand controller interval-based instrument.

FIG. 19 illustrates an embodiment of a hand controller instrument 1900. The embodiment has the form of a hand grip. The buttons 1902 to determine the interval are beneath each finger. A sensor such as a rocking button or a joystick 1904, beneath the thumb, indicates melodic direction. Accelerometers and gyroscopes inside the device can also be used to detect which direction the handgrip is twisted to determine melodic direction. This would allow a musician to control two melodies simultaneously. For example, the joystick 1904 can indicate whether to add or subtract the interval to/from the prior note to generate a new note, while sensor data from an accelerometer or a gyroscope can be used to indicate to add or subtract the interval to/from a different prior note to generate another new note. In one embodiment, the hand controller instrument may not include the joystick 1904, and simply rely on accelerometers and gyroscopes to determine melodic direction.

One minimalistic embodiment can consist of only a neck with interval-selection frets, but no strum bar, that attaches onto a phone or some other external device. For example, if attaching the embodiment to a smartphone, the smartphone can include a corresponding application that receives the button presses or other input signals from the interval frets on the neck. The note direction can be indicated directly on the application by swiping up or down on the touch screen of the smartphone, tablet, smartwatch, or any other device with a suitable connection interface to the instrument. The application on the external device can either generate its own audio or send MIDI events to a separate synthesizer application on the external device itself, to a server, to the cloud, or to some other device. This minimalistic embodiment would be advantageous for students and educators who wish to use a cheaper version of embodiments.

Figure 20A:
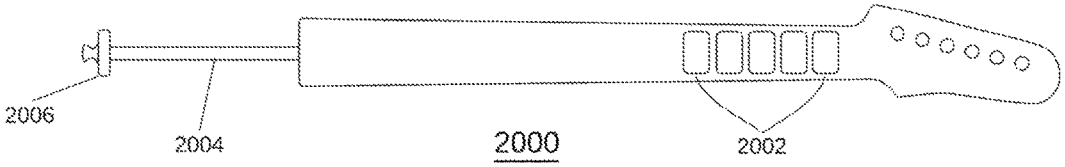
FIGS. 20A-20D illustrate various embodiments of necks without strum bars which can be directly connected to a smartphone, a tablet, or some other device.
Figure 20B:
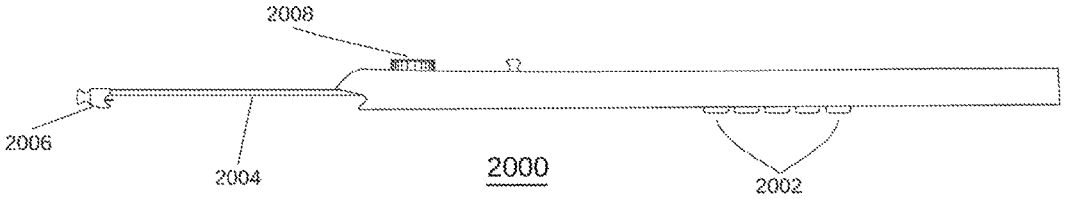

FIGS. 20A-20D illustrate various embodiments of necks without strum bars which can be directly connected to a smartphone, a tablet, or some other device. FIG. 20A illustrates a top down view of an embodiment of neck 2000 with interval buttons 2002. FIG. 20B illustrates a side view of the neck 2000. The neck includes an extensible or telescoping arm 2004 with an adjustable clamp or bracket 2006 on the end of the extensible arm 2004 to hold the external device in place. Different embodiments of the neck can have different shapes and sizes. The arm (or bar) 2004 can be lengthened or shortened with the adjustment knob 2008 on the back of the neck to fit the attached device, though in some embodiments the arm may not be adjustable. The neck 2000 can either be attached directly through the charge port or it can connect wirelessly via Bluetooth or WiFi. The neck can also include a cable for connecting to the attached device. Alternatively, the neck can include a port allowing the attached device to connect to a port with an appropriate interface or cable, such as USB, FireWire, Thunderbolt, etc.

Figure 20C:
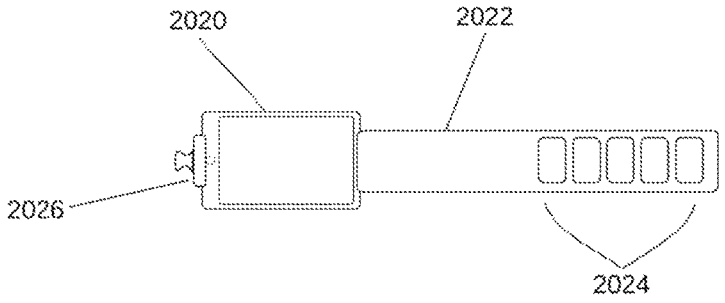
Figure 20D:
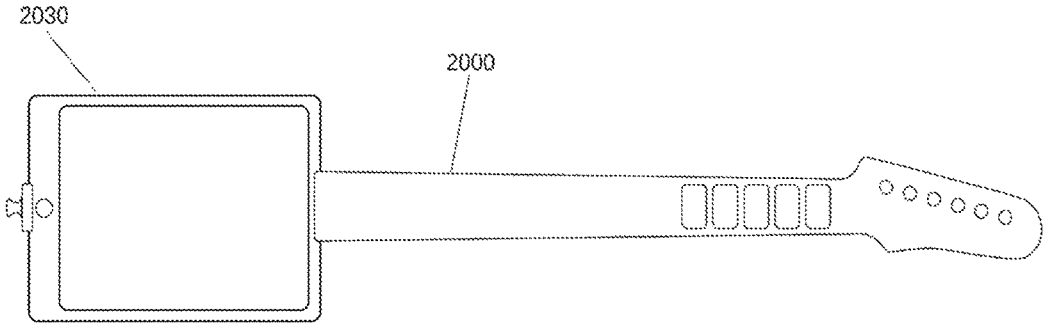

FIG. 20C illustrates a smartphone 2020 attached to a neck 2022 in accordance with an embodiment. The neck includes interval buttons 2024. The smartphone 2020 is secured by clamp 2026. An application on the smartphone 2020 receives information about the interval buttons. The application can also be used to play a note (in place of the physical strum bar). FIG. 20D illustrates a tablet 2030 attached to neck 2000 in accordance with an embodiment.

The neck embodiment can include a processor that receives the state or input signals from the interval buttons. Based on the interval buttons pressed, the processor calculates the interval by which to increase or decrease the previous note to generate a new note. This interval can then be communicated to the attached device, such as a smartphone or tablet.

In yet another embodiment, the state or input signals of the interval buttons can be communicated directly to the attached device, with the application on the attached device calculating the interval by which to increase or decrease the previous note, storing the previous note, and letting the user play the next note by performing an action.

The sensors inside the smartphone (or alternative external device), such as accelerometers, compasses, gyroscopes, or tilt sensors, can be used for effects. If the screen of the touch device is large enough, virtual wheels, sliders, knobs, or touch areas can be used for more effects or for sustain, harmony, or octave buttons. The application on the touch device can also be used as a menu to select options. The display of the touch device can also be animated with decorative effects that respond to the touches of the musician. The touch device's microphone can also be utilized to display graphical effects that correspond with the music that is heard in the room. Signals sent over WiFi or Bluetooth can synchronize the displays of multiple devices.

Using interval-based instruments as described herein encourages and requires a new way to think about music. In order to improvise or to read sheet music, a musician using one of the embodiments of the interval based instrument must first think of the interval between the last played note and the note that should be played next.

Figure 21:
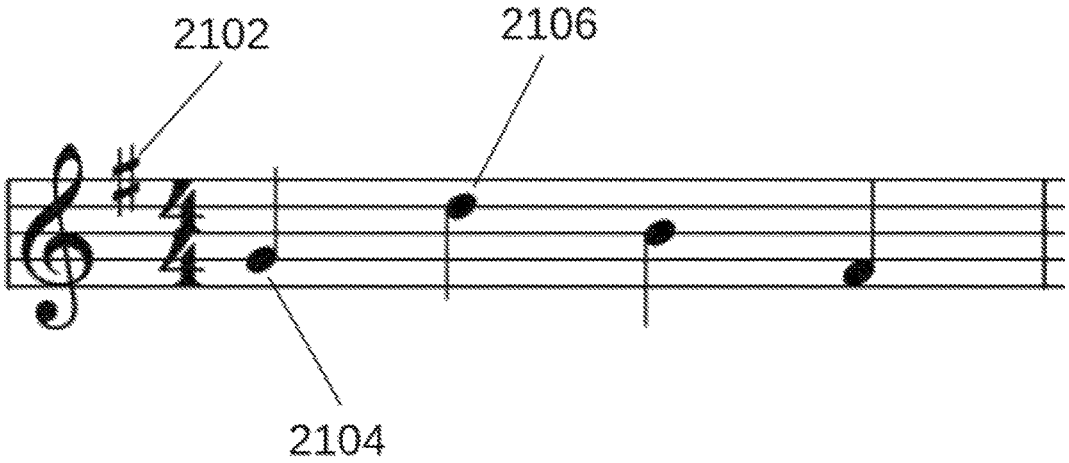
FIG. 21 illustrates an example sheet music.

FIG. 21 illustrates an example sheet music. The lines and white spaces in sheet music correspond to notes in a music scale. The key signature at the very left of a piece of sheet music specifies the key that the scale is in. If there are no sharps (#) or flats (b), the key signature is C major, which corresponds each line or white space to a white key on the piano. In FIG. 21, the sharp 2102 in the key signature on the top line indicates that the note F should be sharp—raised a half-step above the normal F every time it is played, unless otherwise indicated. A scale consists of certain intervals between the keys in the scale. That pattern determines the type of scale and which is the first note in the scale. For a major scale, the interval distances between the notes, in half-steps, beginning with the first note and ending an octave above it, are: 2, 2, 1, 2, 2, 2, 1. In C major, the note C is at the beginning of the major scale interval pattern. In the scale above, since F is raised a half-step, the major scale interval pattern fits only with G being the starting note, so it is the G major scale.

When people are playing piano or other instruments, they can generally ignore the interval pattern and simply concern themselves with the note in the scale. For instance, in FIG. 21, for piano, the musician knows that every key will be white except for F, which will always be its neighboring black key above it.

Two common techniques when reading music are direct association and relative scalar movement. In the first technique, the trained musician directly associates note locations on the musical staff (lines and white spaces) with corresponding physical actions on the instrument, whether it be a key on the piano, holes in a flute, or a location to press on a violin string. Using this method, any isolated note, regardless of the other notes before or after it, can be played by remembering the physical association. For example, the first note 2104 is on the second line, which is the G key on the piano. The second note 2106 is D and could be played without bothering to think about the interval or scalar distance between G and D.

The second method for reading music is to observe the scalar distance between two consecutive notes, meaning the number of lines and spaces in the staff between them, and to play that many notes in the scale, above or below the previous note. In the example above, the second note is five scalar notes above the first. Thus, after G is played, the musician need not necessarily identify the next note as D, but could just play whatever is five notes above G in the scale. This can be carried on for a long series of notes and is the preferred note reading method for series with small interval distances.

The embodiments of the interval-based instrument require the musician to think about interval distance, rather than scalar distance, between two consecutive notes. For instance, there are five scalar notes between G and D in FIG. 21, but how many half-steps? Most intervals that are five scalar notes apart are 7 half-steps apart, but sometimes it is only 6 half-steps, as would be the distance between F# and C in the scale above. The first three notes arpeggiate up three scalar notes each time, or by a third, but are they major thirds (4 half-steps) or minor thirds (3 half-steps)? Using the scalar distance note reading method, the musician generally does not need to know if the thirds are minor or major. A user using embodiments of interval-based instruments as described herein, however, is required to know the exact interval—the exact number of half-steps—between each note in the series to play the music properly.

Ear training is also considered to be an important aspect of a musician's education and a major contributing factor to his/her ability to understand, reproduce, or compose music. Two of ear training's core skills are sight-singing and interval identification. Interval identification allows the musician to identify the exact interval distance between any notes heard audibly, whether in series, as in melodies, or simultaneously, as in chords. Students are usually taught to associate the interval names with instances of that interval being played in popular songs—for instance, the interval between the first two notes of the hymn, "Amazing Grace", is to be remembered as a Perfect 4th (or 5 half-steps); "Love Song" is associated with minor 6th, part of the "Have You Driven a Ford Lately" advertisement jingle is associated with a minor 7th. Using these examples, students are told to compare the interval they hear with the interval from the song and see if they are the same.

To practice these associations, there exist computer programs that play random intervals to quiz the student. There are typically only one or two examples of intervals from popular songs given for each interval. Intervals sound different when played in different contexts. A descending perfect 5th at the end of the song between the 5th note in the scale and the 1st note will usually give the piece a pleasant closure, but if the perfect 5th drops from the 3rd note in the scale to the 6th (two below the 1st), the song will turn darker and more foreboding. Although the same interval, identification can be extremely difficult because the different character that the interval is given by its place in the song. When playing music with interval-based instruments in accordance to embodiments described herein, every exact interval is necessarily identified as it is played, allowing the player to build up an association between the sound of the interval and its name in the wide variety of contexts within the music that is played.

Sight-singing is also considered to be an important skill for a musician. By sight-singing, musicians can "hear" a written piece even before they play it with their instrument, either by singing it or by imagining the sounds in their minds. Sight-singing skills also enable composers to think of and write down music without ever touching their instruments. Sight-singing is usually taught using either solfege or numerical system to represent the notes in a scale. If numerical, the first note in the scale is sung as "one", the second, "two", and so on, until "seven", after which it goes back to "one". Solfege uses sounds other than numbers—do, re, mi, fa, sol, la, ti, do—but means the same thing as the numbers.

Like interval identification, one effective method for teaching sight-singing is to train the musician to remember examples from popular songs. One method that has shown particular success is the Kodály method, which instructs the student to sing and memorize folk songs using solfege. When playing the embodiments of the interval-based instrument, as previously stated, the musician must know the exact interval between two consecutive notes. Because standard sheet music only shows the note locations in the scale, the position of the notes within the scale must be known to calculate the interval. For instance, two notes that are six scalar notes apart could either be a minor 6th or a major 6th, depending on where each note is in the scale. Thus, to find the exact interval between two notes, the scalar, or solfege, position of each of the notes must first be identified.

Playing sheet music with embodiments of the interval-based instrument, such as the interval-based guitar, encourages the musician to identify the position of each note within the scale and every exact interval between two consecutive notes. This builds up a broad opus of example scalar positions and interval distances from which the musician can draw to aid in achieving the ear training skills required by music curriculi.

One embodiment is directed to an interval-based musical instrument, comprising a housing; one or more buttons on the housing, the one or more buttons generating a first set of input signals; a control device generating a second input signal; a memory storing a prior note; a processor calculating an interval based on the first set of input signals, the processor determining a direction for changing a pitch of the prior note based on the second input signal, the processor generating a new note by changing the pitch of the prior note based on the interval and the direction. The processor can change the pitch of the prior note by adding the interval to the prior note if the second input signal is above a first threshold or by subtracting the interval from the prior note if the second input signal is below a second threshold. The processor can store the new note in the memory.

In one embodiment, the second input signal can further determine a volume for the new note. The interval-based instrument can also include a sensor, wherein a value from the sensor determines an effect for the new note.

In one embodiment, the housing is substantially concertina shaped including a right face, a left face, a bellows between the right face and the left face, and a sensor within the bellows, wherein the right face includes a first set of buttons, wherein the left face includes a second set of buttons, wherein the processor calculates the interval based on input signals from the first set of buttons and the second set of buttons, wherein the processor determines a direction for changing the pitch of the prior note based on a change in air flow in the bellows.

In yet another embodiment, the housing is substantially concertina shaped including a right face, a left face, a bellows between the right face and the left face, and a sensor within the bellows, wherein the right face includes a first set of interval buttons, a first up button, and a first down button, wherein the left face includes a second set of interval buttons, a second up button, and a second down button, wherein the first up button and the first down button determine a first direction for changing the pitch of the prior note, wherein the second up button and the second down button determine a second direction for changing a second pitch of a second prior note, wherein the processor calculates a first interval based on input signals from the first set of intervals buttons, wherein the processor calculates a second interval based on input signals from the second set of buttons, wherein a change in air flow in the bellows triggers the processor to change the pitch of the prior note based on the first interval and the first direction, and wherein the change in air flow triggers the processor to change the pitch of the second prior note based on the second interval and the second direction.

The control device can also consist of a rolling cylinder, wherein a rotation of the rolling cylinder determines a direction for changing the pitch of the prior note.

Another embodiment further comprises an up button and a down button, wherein the processor adds the interval to the prior note in response to an input signal from the up button, wherein the processor subtracts the interval from the prior note in response to an input signal from the down button.

Another interval-based musical instrument embodiment is comprised of a substantially guitar shaped housing; one or more buttons on the housing, the one or more buttons generating a first set of input signals; a strum bar on the housing, the strum bar generating a second input signal; a memory storing a prior note; a processor calculating an interval based on the first set of input signals, the processor generating a new note in response to the second input signal, wherein the processor adds the interval to the prior note if the strum bar is moved up, wherein the processor subtracts the interval from the prior note if the strum bar is moved down. The processor can store the new note in the memory. The processor can also generate a MIDI_ON event for the new note when the strum bar is moved, wherein the processor sends a MIDI_OFF event for the new note when the strum bar is released.

The second input signal can further determines a volume for the new note. The housing can include one or more output ports. Each of the one or more buttons can be separated by half-steps. The housing can include an octave button which adds 12 half-steps to the interval based on the first set of input signals. An embodiment can further comprise a sensor, wherein a value from the sensor determines an effect for the new note.

Yet another embodiment is directed to an interval-based musical instrument, comprising a housing; an arm projecting from the housing, wherein the arm includes a clamp to secure a portable electronic device; one or more buttons on the housing, the one or more buttons generating input signals; and a port on the housing for connecting the instrument to the portable electronic device, wherein the input signals are communicated to the portable electronic device via the port. The input signals represent an interval used to change a prior note to generate a new note. The embodiment can further include a sensor on the housing, wherein a value from the sensor is communicated to the portable electronic device via the port.

While embodiments have been illustrated and described herein in terms of several alternatives, it is to be understood that the techniques described herein can have a multitude of additional uses and applications. Accordingly, embodiments should not be limited to just the particular description, embodiments, and various figures contained in this specification that merely illustrate various embodiments. Finally, the various steps from the various alternative embodiments may be combined without departing from the spirit of embodiments described herein.

What is claimed is:

1. An interval-based musical instrument, comprising:

a housing;

one or more buttons on the housing, the one or more buttons generating a first set of input signals, wherein the first set of input signals does not include a direction signal;

a control device generating a second input signal;

a memory storing a prior note generated by the musical instrument, wherein the prior note is an immediately preceding note generated by the musical instrument;

a processor calculating an interval based on the first set of input signals, the processor determining a direction for changing a pitch of the prior note based on the second input signal, the processor generating a new note by changing the pitch of the prior note based on the interval and the direction, wherein the processor saves the new note in memory.

2. The interval-based musical instrument from claim 1, wherein the processor changes the pitch of the prior note by adding the interval to the prior note if the second input signal is above a first threshold, wherein the processor changes the pitch of the prior note by subtracting the interval from the prior note if the second input signal is below a second threshold.

3. The interval-based musical instrument from claim 1, wherein actuation of the control device triggers generation of the new note.

4. The interval-based musical instrument from claim 1, wherein the second input signal further determines a volume for the new note.

5. The interval-based musical instrument from claim 1, further comprising a sensor, wherein a value from the sensor determines an effect for the new note.

6. The interval-based musical instrument from claim 1, wherein the housing is substantially concertina shaped including a right face, a left face, a bellows between the right face and the left face, and a sensor within the bellows, wherein the right face includes a first set of buttons, wherein the left face includes a second set of buttons, wherein the processor calculates the interval based on input signals from the first set of buttons and the second set of buttons, wherein the processor determines a direction for changing the pitch of the prior note based on a change in air flow in the bellows.

7. The interval-based musical instrument from claim 1, wherein the housing is substantially concertina shaped including a right face, a left face, a bellows between the right face and the left face, and a sensor within the bellows, wherein the right face includes a first set of interval buttons, a first up button, and a first down button, wherein the left face includes a second set of interval buttons, a second up button, and a second down button, wherein the first up button and the first down button determine a first direction for changing the pitch of the prior note, wherein the second up button and the second down button determine a second direction for changing a second pitch of a second prior note, wherein the processor calculates a first interval based on input signals from the first set of intervals buttons, wherein the processor calculates a second interval based on input signals from the second set of buttons, wherein a change in air flow in the bellows triggers the processor to change the pitch of the prior note based on the first interval and the first direction, and wherein the change in air flow triggers the processor to change the pitch of the second prior note based on the second interval and the second direction.

8. The interval-based musical instrument from claim 1, wherein the control device comprises a rolling cylinder, wherein a rotation of the rolling cylinder determines a direction for changing the pitch of the prior note.

9. The interval-based musical instrument from claim 1, further comprising an up button and a down button, wherein the processor adds the interval to the prior note in response to an input signal from the up button, wherein the processor subtracts the interval from the prior note in response to an input signal from the down button.

10. An interval-based musical instrument, comprising:

a substantially guitar shaped housing;

one or more buttons on the housing, the one or more buttons generating a first set of input signals;

a strum bar on the housing, the strum bar generating a second input signal;

a memory storing a prior note;

a processor calculating an interval based on the first set of input signals, the processor generating a new note in response to the second input signal, wherein the processor adds the interval to the prior note if the strum bar is moved up, wherein the processor subtracts the interval from the prior note if the strum bar is moved down.

11. The interval-based musical instrument from claim 10, wherein the processor stores the new note in the memory.

12. The interval-based musical instrument from claim 10, wherein the processor generates a MIDI_ON event for the new note when the strum bar is moved, wherein the processor sends a MIDI_OFF event for the new note when the strum bar is released.

13. The interval-based musical instrument from claim 10, wherein the second input signal further determines a volume for the new note.

14. The interval-based musical instrument from claim 10, wherein the housing includes one or more output ports.

15. The interval-based musical instrument from claim 10, wherein each of the one or more buttons are separated by half-steps.

16. The interval-based musical instrument from claim 10, wherein the housing includes an octave button which adds 12 half-steps to the interval based on the first set of input signals.

17. The interval-based musical instrument from claim 10, further comprising a sensor, wherein a value from the sensor determines an effect for the new note.

* * * * *